US008685600B2

(12) United States Patent
Nakamura et al.

(10) Patent No.: US 8,685,600 B2
(45) **Date of Patent: *Apr. 1, 2014**

(54) ELECTROPHOTOGRAPHIC PHOTORECEPTOR, IMAGE FORMING APPARATUS AND PROCESS CARTRIDGE

(75) Inventors: Hirofumi Nakamura, Kanagawa (JP); Keiko Matsuki, Kanagawa (JP); Shingo Hirahara, Kanagawa (JP); Takanori Suga, Kanagawa (JP); Daisuke Haruyama, Kanagawa (JP); Hirokazu Sakashita, Kanagawa (JP); Masahiro Iwasaki, Kanagawa (JP); Takayuki Yamashita, Kanagawa (JP); Mitsuhide Nakamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 473 days.

This patent is subject to a terminal disclaimer.

(21) Appl. No.: 12/623,916

(22) Filed: Nov. 23, 2009

(65) Prior Publication Data

US 2010/0330472 A1 Dec. 30, 2010

(30) Foreign Application Priority Data

Jun. 26, 2009 (JP) ..... 2009-152541

(51) Int. Cl.
*G03G 15/04* (2006.01)
*G03G 15/00* (2006.01)

(52) U.S. Cl.
USPC ..... 430/66; 430/56; 430/58.35; 399/159

(58) Field of Classification Search
USPC ..... 430/56, 59.05, 58.35, 58.75, 66; 399/159
See application file for complete search history.

(56) References Cited

U.S. PATENT DOCUMENTS 4,818,650 A 4/1989 Limburg et al.
4,956,440 A 9/1990 Limburg et al.

(Continued)

FOREIGN PATENT DOCUMENTS

CN 101196697 A 6/2008
EP 0 377 998 A2 7/1990

(Continued)

OTHER PUBLICATIONS

Search Report issued in European Patent Application No. 10156225.4 dated Oct. 7, 2011.

(Continued)

*Primary Examiner* — Thorl Chea
(74) *Attorney, Agent, or Firm* — Oliff PLC

(57) ABSTRACT

There is provided an electrophotographic photoreceptor including a conductive substrate; an intermediate layer; a photosensitive layer; and a surface layer, in this order, the surface layer including two or more charge transporting materials each including a reactive substituent and respectively having mutually different ionization potentials, in an amount of 90% by weight or more relative to the total solid content of the surface layer, and the content ratio X of each of the two or more charge transporting materials satisfying the following Formula (1). X(n) represents a content ratio (weight %) of a charge transporting material that has the $n^{th}$ highest ionization potential among the two or more charge transporting materials; X(n−1) represents a content ratio (weight %) of a charge transporting material that has the $(n-1)^{th}$ highest ionization potential among the two or more charge transporting materials; and n is an integer of two or more and represents a variable equal to or lower than the number of charge transporting materials contained in the surface layer.

$$X(n-1) \geq X(n) \quad \text{Formula (1).}$$

16 Claims, 4 Drawing Sheets

(56) References Cited

U.S. PATENT DOCUMENTS

| | | | | |
|---|---|---|---|---|
| 5,283,145 | A | 2/1994 | Nukada et al. | |
| 5,290,928 | A | 3/1994 | Nukada et al. | |
| 5,298,617 | A | 3/1994 | Nukada et al. | |
| 5,302,479 | A | 4/1994 | Daimon et al. | |
| 5,308,728 | A | 5/1994 | Imai et al. | |
| 5,338,636 | A | 8/1994 | Nukada et al. | |
| 5,358,813 | A | 10/1994 | Iijima et al. | |
| 5,378,569 | A | 1/1995 | Nukada et al. | |
| 5,393,629 | A | 2/1995 | Nukada et al. | |
| 5,416,207 | A | 5/1995 | Imai et al. | |
| 5,456,989 | A | 10/1995 | Nogami et al. | |
| 5,459,004 | A | 10/1995 | Daimon et al. | |
| 5,463,043 | A | 10/1995 | Nukada et al. | |
| 5,639,581 | A | 6/1997 | Iwasaki et al. | |
| 5,654,119 | A | 8/1997 | Ishii et al. | |
| 5,734,003 | A | 3/1998 | Iwasaki et al. | |
| 5,932,384 | A * | 8/1999 | Mitsumori et al. | 430/58.8 |
| 6,180,303 | B1 | 1/2001 | Uematsu et al. | |
| 6,489,069 | B1 | 12/2002 | Itami et al. | |
| 6,555,279 | B2 | 4/2003 | Nakata et al. | |
| 6,829,454 | B2 | 12/2004 | Miyakawa et al. | |
| 7,302,210 | B2 | 11/2007 | Fukushima et al. | |
| 7,384,717 | B2 * | 6/2008 | Dinh et al. | 430/66 |
| 2001/0031412 | A1 * | 10/2001 | Itami et al. | 430/58.15 |
| 2002/0106570 | A1 | 8/2002 | Kami et al. | |
| 2002/0119382 | A1 | 8/2002 | Nakata et al. | |
| 2003/0129512 | A1 | 7/2003 | Sugino et al. | |
| 2003/0194625 | A1 | 10/2003 | Tanaka et al. | |
| 2004/0063014 | A1 | 4/2004 | Yoshimura et al. | |
| 2005/0026058 | A1 | 2/2005 | Kami et al. | |
| 2005/0181291 | A1 | 8/2005 | Kami et al. | |
| 2006/0093931 | A1 | 5/2006 | Itami | |
| 2006/0199092 | A1 | 9/2006 | Sugino et al. | |
| 2007/0065741 | A1 * | 3/2007 | Iemura et al. | 430/60 |
| 2007/0077506 | A1 | 4/2007 | Kihara et al. | |
| 2007/0148570 | A1 | 6/2007 | Iwasaki et al. | |
| 2007/0166634 | A1 | 7/2007 | Qi et al. | |
| 2008/0026308 | A1 | 1/2008 | Qi et al. | |
| 2008/0089712 | A1 | 4/2008 | Nukada et al. | |
| 2008/0107980 | A1 | 5/2008 | De Jong et al. | |
| 2009/0004583 | A1 * | 1/2009 | Nukada et al. | 430/58.5 |
| 2009/0067874 | A1 | 3/2009 | Hoshio | |
| 2009/0117476 | A1 * | 5/2009 | Heuft et al. | 430/48 |
| 2009/0238602 | A1 * | 9/2009 | Iwasaki et al. | 399/111 |
| 2010/0167193 | A1 | 7/2010 | Nukada et al. | |
| 2010/0330473 | A1 | 12/2010 | Haruyama et al. | |

FOREIGN PATENT DOCUMENTS

| | | | |
|---|---|---|---|
| EP | 0 710 893 | A1 | 5/1996 |
| EP | 1 211 565 | A1 | 6/2002 |
| EP | 1 600 822 | A2 | 11/2005 |
| EP | 1 808 732 | A1 | 7/2007 |
| EP | 2 202 582 | A1 | 6/2010 |
| EP | 2 233 979 | A1 | 9/2010 |
| JP | A-56-51749 | | 5/1981 |
| JP | A-60-247647 | | 12/1985 |
| JP | A-62-251757 | | 11/1987 |
| JP | A-64-1728 | | 1/1989 |
| JP | A-02-255856 | | 10/1990 |
| JP | A-04-189873 | | 7/1992 |
| JP | A-4-281461 | | 10/1992 |
| JP | A-5-43823 | | 2/1993 |
| JP | A-05-098181 | | 4/1993 |
| JP | A-05-099737 | | 4/1993 |
| JP | A-05-140472 | | 6/1993 |
| JP | A-05-140473 | | 6/1993 |
| JP | A-05-263007 | | 10/1993 |
| JP | A-05-279591 | | 10/1993 |
| JP | A-7-146564 | | 6/1995 |
| JP | A-08-176293 | | 7/1996 |
| JP | A-08-208820 | | 8/1996 |
| JP | A-8-278645 | | 10/1996 |
| JP | A-2000-019749 | | 1/2000 |
| JP | A-2000-066424 | | 3/2000 |
| JP | A-2000-292959 | | 10/2000 |
| JP | A-2001-201876 | | 7/2001 |
| JP | A-2001-255685 | | 9/2001 |
| JP | A-2002-006524 | | 1/2002 |
| JP | A-2002-082469 | | 3/2002 |
| JP | A-2002-82469 | | 3/2002 |
| JP | B2-3287678 | | 3/2002 |
| JP | A-2003-084474 | | 3/2003 |
| JP | A-2003-186222 | | 7/2003 |
| JP | A-2003-186234 | | 7/2003 |
| JP | A-2004-004454 | | 1/2004 |
| JP | A-2005-062830 | | 3/2005 |
| JP | A-2005-107401 | | 4/2005 |
| JP | A-2005-195961 | | 7/2005 |
| JP | A-2005-234081 | | 9/2005 |
| JP | A-2005-234140 | | 9/2005 |
| JP | A-2005-234546 | | 9/2005 |
| JP | A-2006-084711 | | 3/2006 |
| JP | A-2006-259155 | | 9/2006 |
| JP | A-2006-267652 | | 10/2006 |
| JP | A-2006-276103 | | 10/2006 |
| JP | A-2007-086209 | | 4/2007 |
| JP | A-2007-155874 | | 6/2007 |
| JP | A-2007-188051 | | 7/2007 |
| JP | A-2008-299039 | | 12/2008 |
| JP | A-2010-224173 | | 10/2010 |

OTHER PUBLICATIONS

Apr. 24, 2012 Office Action issued in Chinese Patent Application No. 200910253353.1 (with translation).
May 10, 2013 Office Action issued in U.S. Appl. No. 12/049,718.
Japanese Patent Office, Notice of Reasons for Rejection mailed Aug. 6, 2013 in Japanese Patent Application No. 2009-152541 w/English-language Translation.
Sep. 3, 2013 Office Action issued in U.S. Appl. No. 12/049,718.
Jun. 28, 2010 Office Action issued in Japanese Patent Application No. 2008-071840 (with Translation).
Apr. 13, 2010 Office Action issued in Japanese Patent Application No. 2007-328748 (with translation).
Oct. 26, 2010 Search Report in European Patent Application No. 10155500.1.
Jikken Kagaku Kohza, "Experimental Chemical Lecture", 4th Edition, vol. 28, pp. 430-431 (with translation).
Jun. 7, 2012 Office Action issued in U.S. Appl. No. 12/627,723.
Jan. 9, 2012 Office Action issued in U.S. Appl. No. 12/627,723.
Dec. 3, 2012 Office Action issued in U.S. Appl. No. 12/049,718.
Jun. 12, 2012 Office Action issued in U.S. Appl. No. 12/049,718.
Jan. 13, 2012 Office Action issued in U.S. Appl. No. 12/049,718.
Sep. 12, 2011 Office Action issued in U.S. Appl. No. 12/049,718.
Apr. 26, 2011 Office Action issued in U.S. Appl. No. 12/049,718.
Dec. 10, 2010 Office Action issued in U.S. Appl. No. 12/049,718.
Mar. 9, 2012 Office Action issued in U.S. Appl. No. 12/247,794.
Aug. 30, 2011 Office Action issued in U.S. Appl. No. 12/247,794.
Mar. 29, 2011 Office Action issued in U.S. Appl. No. 12/247,794.
U.S. Appl. No. 12/627,723 in the name of Haruyama et al, filed Nov. 30, 2009.
U.S. Appl. No. 12/247,794 in the name of Iwasaki et al., filed Oct. 8, 2008.
U.S. Appl. No. 12/049,718, filed Mar. 17, 2008 in the name of Nukada et al.

* cited by examiner

ELECTROPHOTOGRAPHIC PHOTORECEPTOR, IMAGE FORMING APPARATUS AND PROCESS CARTRIDGE

CROSS-REFERENCE TO RELATED APPLICATION

This application is based on and claims priority under 35 USC 119 from Japanese Patent Application No. 2009-152541 filed on Jun. 26, 2009.

BACKGROUND

1. Technical Field

The present invention relates to an electrophotographic photoreceptor, an image forming apparatus and a process cartridge.

2. Related Art

Image forming apparatuses operating in a so-called xerographic mode are each equipped with an electrophotographic photoreceptor, a charging device, an exposure device, a developing device, a transfer device and the like, and carry out image formation by electrophotographic processes using those devices.

SUMMARY

According to an aspect of the present invention, there is provided an electrophotographic photoreceptor including:

a conductive substrate;

an intermediate layer;

a photosensitive layer; and a surface layer, in this order, the surface layer including two or more charge transporting materials each including a reactive substituent and respectively having mutually different ionization potentials, in an amount of about 90% by weight or more relative to the total solid content of the surface layer, and the content ratio X of each of the two or more charge transporting materials satisfying the following Formula (1):

$$X(n-1) \geq X(n) \qquad \text{Formula (1)}$$

wherein in Formula (1), X(n) represents a content ratio expressed by % by weight of a charge transporting material that has the $n^{th}$ highest ionization potential among the two or more charge transporting materials; X(n−1) represents a content ratio expressed by % by weight of a charge transporting material that has the $(n-1)^{th}$ highest ionization potential among the two or more charge transporting materials; and n is an integer of two or more and represents a variable equal to or lower than the number of charge transporting materials contained in the surface layer.

BRIEF DESCRIPTION OF THE DRAWINGS

Exemplary embodiments of the present invention will be described in detail based on the following figures, wherein.

DETAILED DESCRIPTION

Figure 1:
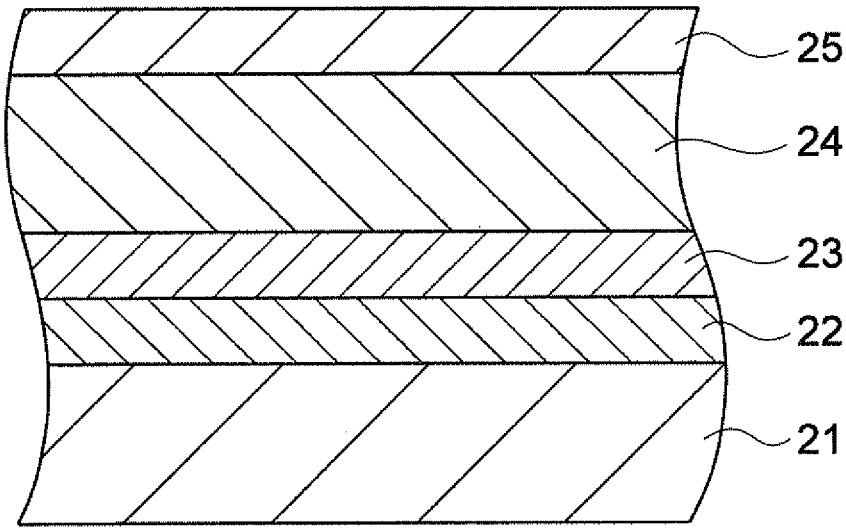
FIG. 1 is a schematic cross-sectional view depicting the layer structure in an example of the photoreceptor of the exemplary embodiment of the invention.

Hereinafter, an exemplary embodiment of the present invention will be described.

Electrophotographic Photoreceptor

An electrophotographic photoreceptor (hereinafter, may be simply referred to as "photoreceptor") of the exemplary embodiment includes a conductive substrate; an intermediate layer; a photosensitive layer; and a surface layer, in this order, the surface layer includes two or more charge transporting materials each including a reactive substituent and respectively having mutually different ionization potentials, in an amount of 90% by weight (or about 90% by weight) or more, and preferably 94% by weight (or about 94% by weight) or more, relative to the total solid content of the surface layer, and the content ratio X of each of the two or more charge transporting materials satisfies the following Formula (1).

$$X(n-1) \geq X(n) \qquad \text{Formula (1)}$$

In Formula (1), X(n) represents a content ratio expressed by % by weight of a charge transporting material that has the $n^{th}$ highest ionization potential among the two or more charge transporting materials; X(n−1) represents a content ratio expressed by % by weight of a charge transporting material that has the $(n-1)^{th}$ highest ionization potential among the two or more charge transporting materials; and n is an integer of two or more and represents a variable equal to or lower than the number of charge transporting materials contained in the surface layer.

Here, Formula (1) will be explained.

The photoreceptor of the exemplary embodiment contains, in the surface layer, two or more charge transporting materials each including a reactive substituent and respectively having mutually different ionization potentials, and the content ratio X of each of the two or more charge transporting materials satisfies Formula (1) shown above. That is, If the surface layer includes two charge transporting materials, the following Formula (1-2) is satisfied:

$$X(1) \geq X(2) \qquad \text{Formula (1-2)}$$

If the surface layer includes three charge transporting materials, the following Formula (1-3) is satisfied:

$$X(1) \geq X(2) \geq X(3) \qquad \text{Formula (1-3)}$$

If the surface layer includes x kinds (x≥4) of charge transporting materials (that is, the number of charge transporting materials contained in the surface layer is x), the following Formula (1-x) is satisfied:

$$X(1) \geq X(2) \geq X(3) \ldots \geq X(x) \qquad \text{Formula (1-x)}$$

In Formula (1-2), Formula (1-3) and Formula (1-x), X(1) represents the content ratio expressed by % by weight of a charge transporting material that has the highest ionization potential among the two or more charge transporting materials, X(2) represents the content ratio expressed by % by weight of a charge transporting material that has the second highest ionization potential, X(3) represents the content ratio expressed by % by weight of a charge transporting material that has the third highest ionization potential, and X(x) represents the content ratio expressed by % by weight of a charge transporting material that has the $x^{th}$ ionization potential.

That is, according to the exemplary embodiment, when the number of charge transporting materials contained in the photoreceptor is x (x≥4), the content of the charge transporting material having the highest ionization potential is greater than or equal to the content of the charge transporting material having the second highest ionization potential; the content of the charge transporting material having the second highest ionization potential is greater than or equal to the content of the charge transporting material having the third highest ionization potential; and the content of the charge transporting material having the $(x-1)^{th}$ highest ionization potential is greater than or equal to the content of the charge transporting material having the $x^{th}$ highest ionization potential (in other words, the charge transporting material having the lowest ionization potential).

Therefore, the content of the charge transporting material having the highest ionization potential is greater than or equal to the content of any one of the other charge transporting materials, whereas the content of the charge transporting material having the lowest ionization potential is smaller than or equal to the content of each of the other charge transporting materials.

Heretofore, there have been cases in which when a photoreceptor is used as a latent image holding member of an image forming apparatus, discharge products such as ozone and NOx generated by a charging device attach to the surface of the photoreceptor, and image degradation occurs under high temperature and high humidity. There also have been cases in which, after the image forming apparatus is stopped from operating, discharge products accumulated in the charging device are released again and attach to the surface of the photoreceptor, and image degradation occurs after standing for a while.

In particular, a charge transporting material that is used in the surface layer of a photoreceptor having a curable surface layer, tends to be exposed for a longer time to highly oxidative substances such as discharge products and discharge gases, because the surface layer has a low rate of abrasion. When a charge transporting material is exposed to a highly oxidative substance for a long time, the charge transporting material may react with the oxidative substance and become decomposed. Also, there have been some cases in which even if the material does not undergo decomposition, when the charge transporting material is deprived of electrons by the highly oxidative substance, the charge transporting material is cationically radicalized, and the number of carriers in the surface layer is increased, so that the potential obtainable after exposure is lowered to cause an increase in the image density, or a decrease in the image density occurs as a result of charge transfer in the horizontal direction.

The cationic radicalization occurring in the charge transporting material is a phenomenon that is unavoidable due to the mechanism of charge transfer. That is, the charge transporting material exchanges electrons with the molecules of other charge transporting materials, and transports charges while repeating oxidation and reduction. Since the charge transporting material easily transfer electrons, that is, is easily oxidized, changes in the image density due to a highly oxidative substance are prone to occur.

The photoreceptor of the exemplary embodiment is such that, as previously described, the content of the charge transporting material having the highest ionization potential in the surface layer is greater than or equal to the content of each of the other charge transporting materials, and the content of the charge transporting material having the lowest ionization potential is smaller than or equal to the content of each of the other charge transporting materials. The ionization potential being high implies that the energy needed to extract an electron is high, and implies that it is difficult to extract electrons. Therefore, in the photoreceptor of the exemplary embodiment, when the contents of plural charge transporting materials are controlled in accordance with their ionization potentials, the occurrence of image degradation may be suppressed while the residual potential may be suppressed.

Furthermore, when the photoreceptor of the exemplary embodiment is used as a latent image holding member of the image forming apparatus, the residual potential may be suppressed, and the occurrence of image degradation as a result of the exposure of the photoreceptor to highly oxidative substances such as discharge products, may also be suppressed.

Here, it is preferable that Formula (1) further satisfies the following Formula (1').

$$X(n-1)>X(n) \qquad \text{Formula (1')}$$

It is also preferable that when the surface layer contains m kinds (m is an integer of 2 or larger) of charge transporting materials each including a reactive substituent and respectively having mutually different ionization potentials, the surface layer satisfy the following Formula (2).

$$X(m-1)\geq 2X(m) \qquad \text{Formula (2)}$$

In Formula (2), X(m) represents the content ratio (% by weight) of a charge transporting material having the $m^{th}$ highest ionization potential among the m kinds of charge transporting materials; X(m−1) represents the content ratio (% by weight) of a charge transporting material having the $(m-1)^{th}$ highest ionization potential among the m kinds of charge transporting materials; and m represents the number of the charge transporting materials contained in the surface layer.

It is more preferable that the surface layer of the exemplary embodiment contain three or more charge transporting materials each including a reactive substituent and respectively having mutually different ionization potentials.

Here, the "reactive substituent" represents a substituent which reacts with another substituent under external stimulation of heat, light or the like and binds to the substituent. Specific examples of the reactive substituent include, for example, —OH, —$OCH_3$, —$NH_2$, —SH, —COOH, and the like.

—Measurement of Ionization Potential—

The measurement of the ionization potential of the charge transporting material is carried out using a photoelectron spectroscopy in air (trade name: AC-2, manufactured by Riken Keiki Co., Ltd.). The values described herein are obtained by this method.

Next, the photoreceptor of the exemplary embodiment of the invention will be described in detail while referring to the drawings. In the following, a photoreceptor including a functional separation type photosensitive layer including a charge generating layer and a charge transporting layer, will be described as an example of the photoreceptor of the exemplary embodiment.

FIG. 1 is a schematic diagram showing the cross-section of a photoreceptor of the exemplary embodiment. In FIG. 1, an intermediate layer 22 is provided on a conductive substrate 21, and a charge generating layer 23 and a charge transporting layer 24 are provided thereon. Furthermore, a surface layer 25 is further provided on the photosensitive layer (charge generating layer 23 and charge transporting layer 24).

a. Conductive Substrate

In regard to the conductive substrate 21, for example, a substrate formed of aluminum may be used. The conductive substrate may in the shape of, for example, but without being limited to, a drum, a sheet, a plate or the like. The conductive substrate may also be subjected to an anodizing treatment, a boehmite treatment, a homing treatment or the like.

b. Intermediate Layer

Examples of the material which may be used in the intermediate layer 22 include an organic zirconium compound, an organic titanium compound, an organic aluminum compound, and other organic metal compounds, and preferable examples of the material which may be used in the intermediate layer 22 include an organic zirconium compound, an organic titanyl compound and an organic aluminum compound.

The intermediate layer 22 may also contain a known binding resin such as polyvinyl alcohol, polyvinyl methyl ether, poly-N-vinylimidazole, polyethylene oxide, ethylcellulose, methylcellulose, an ethylene-acrylic acid copolymer, polyimide, polyimide, casein, gelatin, polyethylene, polyester, a phenolic resin, a vinyl chloride-vinyl acetate copolymer, an epoxy resin, polyvinylpyrrolidone, polyvinylpyridine, polyurethane, polyglutamic acid or polyacrylic acid.

The intermediate layer 22 may also have an electron transportable pigment mixed/dispersed therein. Examples of the electron transportable pigment include organic pigments such as a perylene pigment, a bisbenzimidazole perylene pigment, a polycyclic quinone pigment, an indigo pigment and a quinacridone pigment; and inorganic pigments such as zinc oxide and titanium oxide. These pigments may also be surface treated with a coupling agent such as those mentioned above, a binder or the like, for the purpose of controlling dispersibility and charge transportability.

c. Charge Generating Layer

Next, the charge generating layer 23 will be described. The charge generating layer 23 may include a charge generating material and a binding resin. The charge generating material is preferably a phthalocyanine compound that has photosensitivity in the infrared region and is highly sensitive. The charge generating material is more preferably hydroxygallium phthalocyanine having diffraction peaks at Bragg angles (2θ±0.2) of at least 7.5°, 9.9°, 12.5°, 16.3°, 18.6°, 25.1° and 28.1° in an X-ray diffraction spectrum measured with CuKα ray, or titanylphthalocyanine having diffraction peaks at Bragg angles (2θ±0.2) of at least 7.6°, 18.3°, 23.2°, 24.2° and 27.3° in an X-ray diffraction spectrum measured with Cu-Kα ray.

The binding resin may be selected from a wide variety of insulating resins, and may also be selected from organic photoconductive polymers. Examples of the binding resin include a polyester resin, a methacrylic resin, an acrylic resin, a polyvinyl chloride resin, a polystyrene resin, a polyvinyl acetate resin, a styrene-butadiene copolymer resin, a vinylidene chloride-acrylonitrile copolymer resin, a vinyl chloride-vinyl acetate-maleic anhydride resin, a silicone resin, a silicone-alkyd resin, a phenol-formaldehyde resin, a styrene-alkyd resin, poly-N-vinylcarbazole and the like. The binding resins may be used individually or as mixtures of two or more resins.

d. Charge Transporting Layer

Next, the charge transporting layer 24 will be described. The charge transporting layer 24 may include a charge transporting material and a binding resin. As the charge transporting material, a known charge transporting material may be used. The charge transporting materials may be used individually as a single charge transporting material, or may be used in combination of two or more charge transporting materials.

The binding resin of the charge transporting layer 24 is not particularly limited, but a known electrically insulating resin capable of film forming is preferred. Among them, preferable examples include a polycarbonate resin, a polyester resin, a methacrylic resin, and an acrylic resin. These binding resins may be used individually as a single resin, or may be used in combination of two or more resins.

Furthermore, additive(s) such as an antioxidant, a photostabilizer and/or a thermal stabilizer may also be added into the photosensitive layer (charge generating layer 23 and charge transporting layer 24).

e. Surface Layer

Next, the surface layer 25 will be described. The surface layer is a layer constituting the outermost surface in the photoreceptor of the exemplary embodiment, and is a layer provided in order to impart resistance to abrasion, scratches and the like to the outermost surface.

The surface layer 25 contains two or more charge transporting materials each including a reactive substituent and respectively having mutually different ionization potentials, in an amount of 90% by weight (or about 90% by weight) or more relative to the total solid content of the surface layer, and the content ratio X of each of the two or more charge transporting materials satisfies the relationship represented by Formula (1).

It is preferable that the thickness of the surface layer 25 be 5 μm (or about 5 μm) or more and 15 μm (or about 15 μm) or less. When the thickness of the surface layer 25 is 5 μm or more, the lifespan of the photoreceptor may be extended. When the thickness is 15 μm or less, favorable properties of the surface layer may be maintained even when the photoreceptor is used for a long time period, and an increase in the residual potential may be suppressed.

Charge Transporting Material

The charge transporting material used in the surface layer 25 includes a reactive substituent. The charge transporting material may be, for example, a charge transporting material including at least one substituent selected from the group consisting of —OH, —$OCH_3$, —$NH_2$, —SH, and —COOH, and is preferably a compound having a structure represented by the following Formula (I).

$$F\text{—}((\text{—}R^{12}\text{—}X)_{n1}(R^{13})_{n3}\text{—}Y)_{n2} \qquad \text{Formula (I)}$$

In Formula (I), F is an organic group derived from a compound capable of hole-transporting; $R^{12}$ and $R^{13}$ are each independently an alkylene group having from 1 to 5 carbon atoms which may be branched; n1 is 0 or 1, n2 is an integer of from 1 to 4; n3 is 0 or 1; X is an oxygen atom, NH or a sulfur atom, and Y is —OH, —$OCH_3$, —$NH_2$, —SH or —COOH.

Specific examples of the compound represented by Formula (1) include the following compounds.

I-1

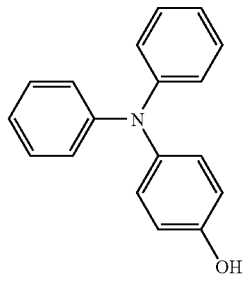

-continued
I-2
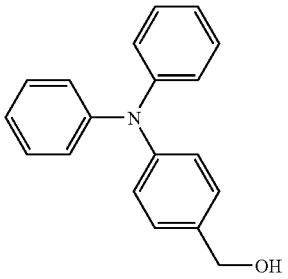
I-3
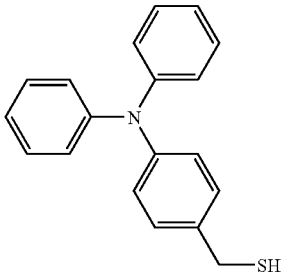
I-4
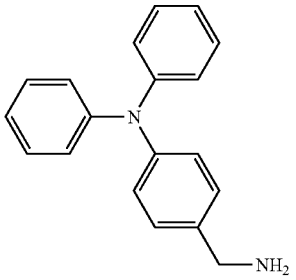
I-5
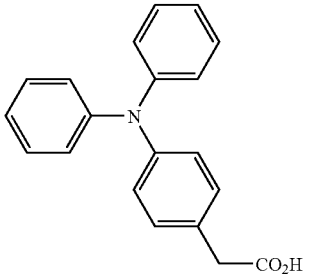
I-6
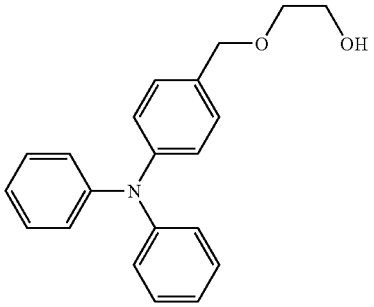
-continued
I-7
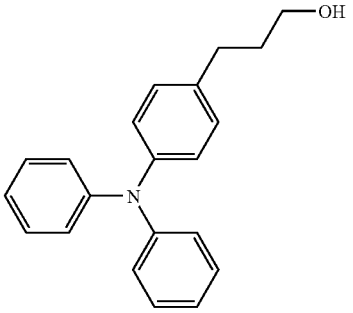
I-8
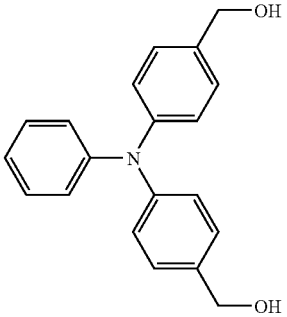
I-9
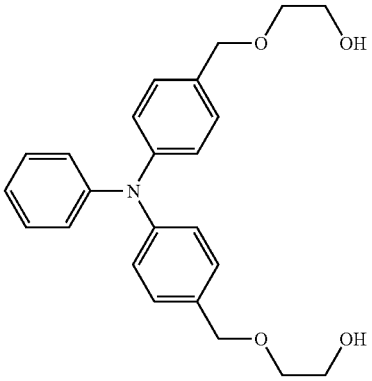
I-10
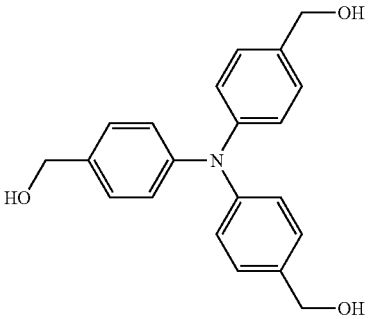

-continued
I-11
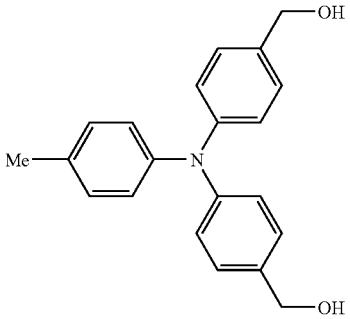
I-12
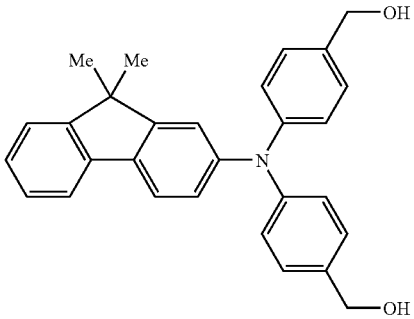
I-13
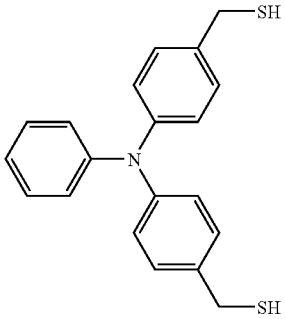
I-14
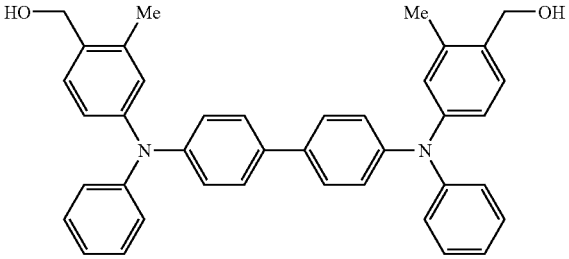
I-15
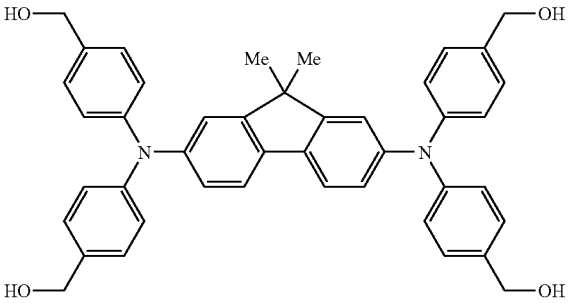
-continued
I-16
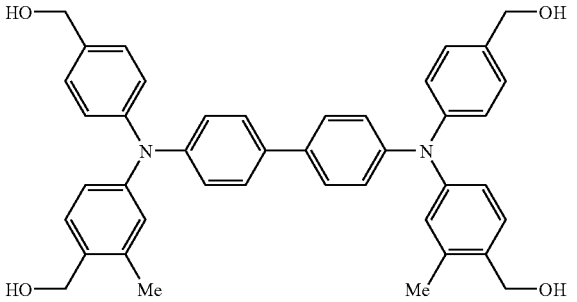
I-17
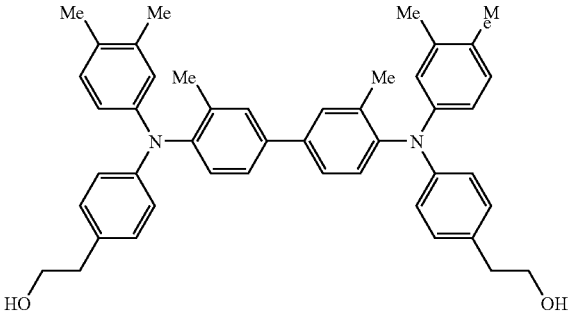
I-18
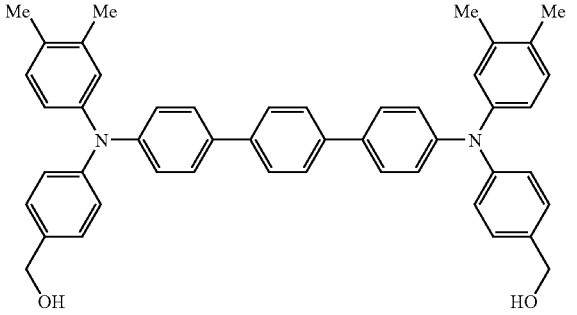
I-19
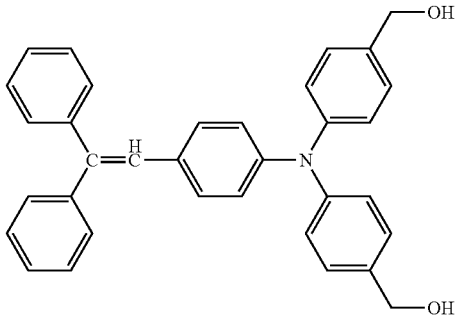
I-20
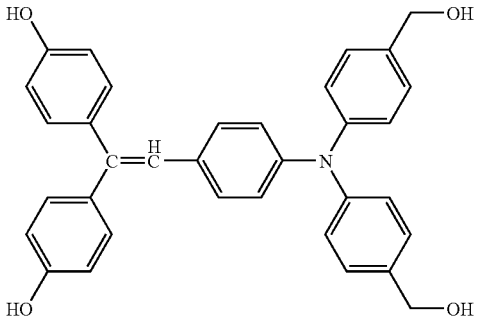

-continued
I-21
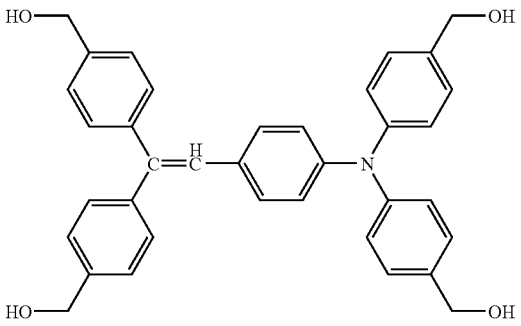
I-22
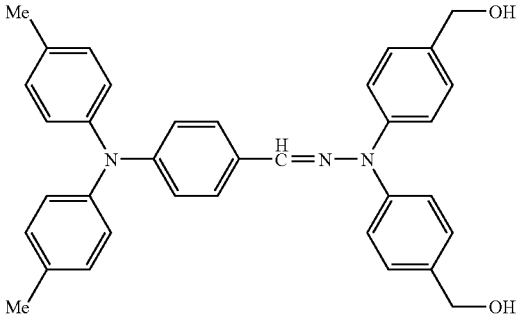
I-23
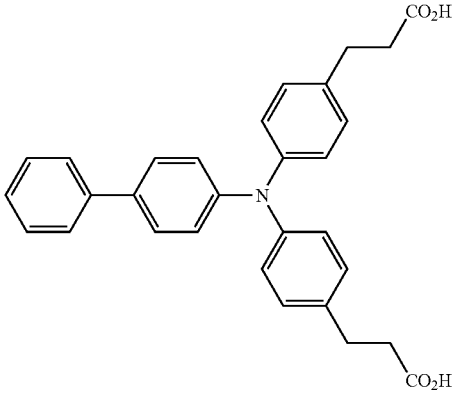
I-24
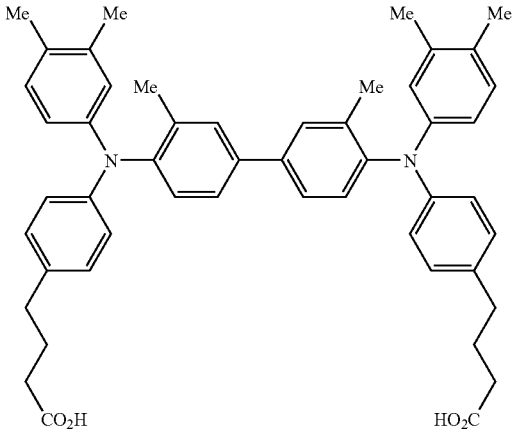
-continued
I-25
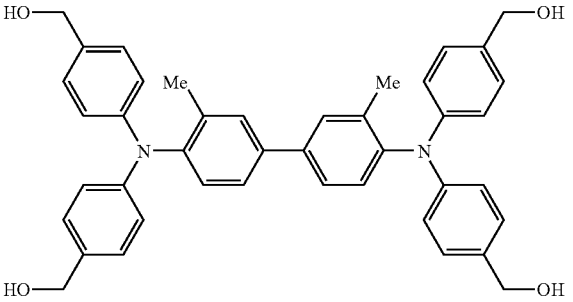
I-26
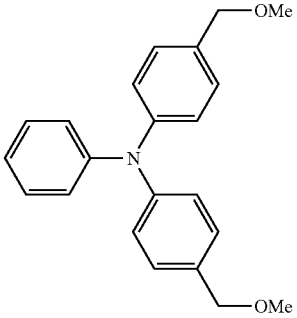
I-27
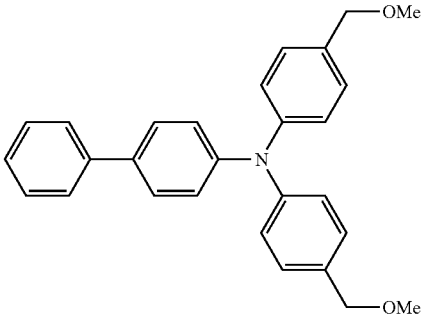
I-28
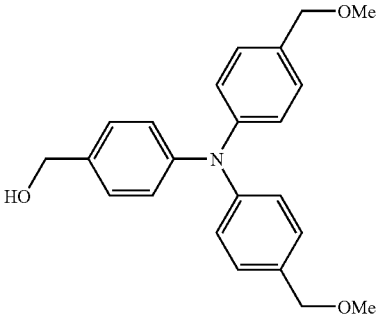
I-29
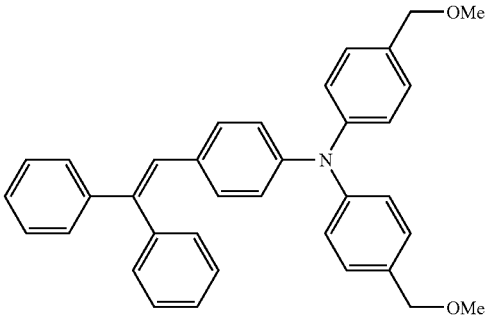

-continued

I-30

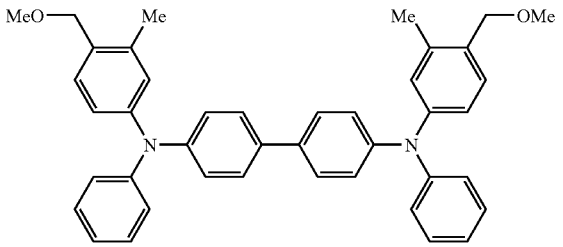

I-31

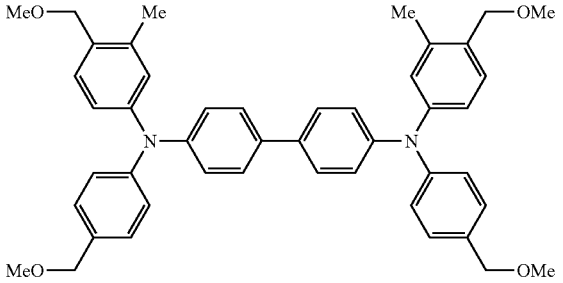

Other Materials

The surface layer may include at least one of a guanamine compound represented by the following formula (A) and a melamine compound represented by the following formula (B).

Formula (A)

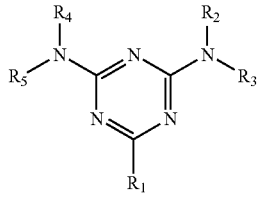

In formula (A), $R_1$ is an alkyl group having from 1 to 10 carbon atoms which may be branched, or a substituted or unsubstituted phenyl group having from 6 to 10 carbon atoms; $R_2$ through $R_5$ are each independently a hydrogen atom, —$CH_2$—OH or —$CH_2$—O—$R_{14}$, wherein $R_{14}$ is an alkyl group having from 1 to 5 carbon atoms which may be branched.

Formula (B)

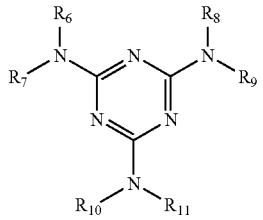

In Formula (B), $R_6$ through $R_{11}$ are each independently a hydrogen atom, —$CH_2$—OH or —$CH_2$—O—$R_{15}$, wherein $R_{15}$ is an alkyl group having from 1 to 5 carbon atoms which may be branched.

In the surface layer 25, a coupling agents and/or a fluorine compound may further be incorporated. Examples of such compounds include various silane-coupling agents and commercially available silicone-based hard coating agents.

In the surface layer 25, a resin which dissolves in alcohol may be added.

A catalyst may also be used in the surface layer 25. As a curable catalyst, an acid-based catalyst is preferably used. Examples of the acid-based catalyst include aliphatic carboxylic acids such as acetic acid, chloroacetic acid, trichloroacetic acid, trifluoroacetic acid, oxalic acid, maleic acid, malonic acid and lactic acid; aromatic carboxylic acids such as benzoic acid, phthalic acid, terephthalic acid and trimellitic acid; aliphatic and aromatic sulfonic acids such as methanesulfonic acid, dodecylsulfonic acid, benzenesulfonic acid, dodecylbenzenesulfonic acid and naphthalenesulfonic acid; and the like. However, it is preferable to use sulfur-containing materials. The amount of incorporation of the catalyst is preferably 0.01% by weight or more and 5% by weight or less relative to the solid content.

Image Forming Apparatus and Process Cartridge

Next, an image forming apparatus and a process cartridge of the exemplary embodiment of the invention will be described.

The image forming apparatus of the exemplary embodiment includes a photoreceptor of the exemplary embodiment as described above; a charging device that charges the photoreceptor; a latent image forming device that exposes the surface of the charged photoreceptor to form an electrostatic latent image; a developing device that develops the electrostatic latent image formed on the surface of the photoreceptor to form a toner image; a transfer device that transfers the toner image formed on the surface of the photoreceptor to the surface of a recording medium; and a cleaning device that cleans the surface of the photoreceptor.

The process cartridge of the exemplary embodiment is attachable to and detachable from the image forming apparatus, and includes at least one selected from the group consisting of a photoreceptor of the exemplary embodiment as described above, a charging device that charges the photoreceptor, a latent image forming device that exposes the surface of the charged photoreceptor to form an electrostatic latent image, a developing device that develops the electrostatic latent image formed on the surface of the electrophotographic photoreceptor to form a toner image, a transfer device that transfers the toner image formed on the surface of the electrophotographic photoreceptor to the surface of a recording medium, and a cleaning device that cleans the surface of the photoreceptor.

In the following, the image forming apparatus and the process cartridge of the exemplary embodiment of the invention will be described in detail while referring to the drawings.

Figure 2:
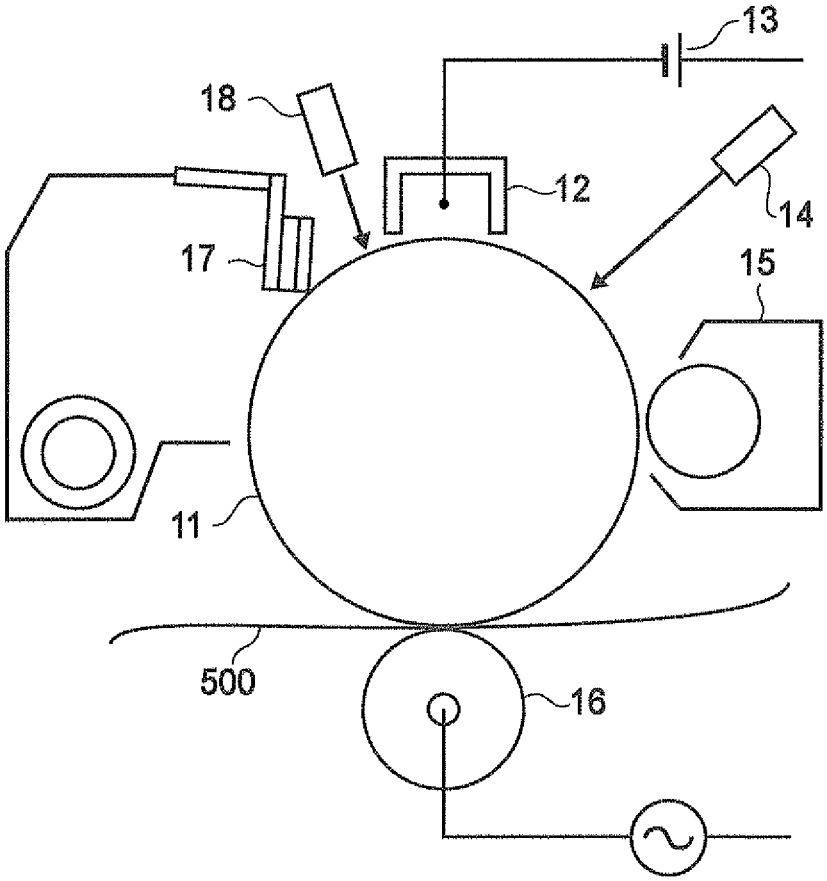
FIG. 2 is a cross-sectional view depicting an outline of the basic configuration of an example of the image forming apparatus of the exemplary embodiment of the invention.

FIG. 2 is a cross-sectional view depicting an outline of a basic configuration of an example of the image forming apparatus of the exemplary embodiment. The image forming apparatus shown in FIG. 2 includes a photoreceptor 11 of the exemplary embodiment as described above; a charging device 12 of contact charging type that charges the photoreceptor 11; a power supply 13 connected to the charging device 12; an exposure device 14 that exposes the photoreceptor 11 charged by the charging device 12, to form an electrostatic latent image; a developing device 15 that develops the electrostatic latent image formed by the exposure device 14 using a toner, to form a toner image; a transfer device 16 that transfers the toner image formed by the developing device 15 to a recording medium 500; a cleaning device 17; and a charge eraser 18. In an exemplary embodiment, the image forming apparatus may be the apparatus that is not provided with the charge eliminating device 18.

The charging device 12 is a non-contact type charging device that applies a voltage to the photoreceptor 11 without contacting with the surface of the photoreceptor 11, and charges the surface of the photoreceptor 11 to a predetermined potential. Specifically, a non-contact type charge device such as a corotron or a scorotron may be used.

As for the exposure device 14, an optical device capable of required-imagewise light exposure using a light source such as a semiconductor laser, a light emitting diode (LED) or a liquid crystal shutter, on the surface of the photoreceptor 11, or the like, may be used.

As for the developing device 15, a conventionally known developing device using a normal or reversal developer such as of a one-component system or a two-component system, is used. The shape of the toner used in the developing device 15 is not particularly limited, and a toner having an irregular shape, a spherical shape, or even some other specific shape may be used.

The transfer device 16 may be a roller-shaped contact type transfer charging member; a contact type transfer charging unit using a belt, a film, a rubber blade or the like; a scorotron transfer charging unit or corotron transfer charging unit utilizing corona discharge; or the like.

The cleaning device 17 is a device for removing any residual toner, paper dust or the like, which remains attached to the surface of the photoreceptor 11 after the transfer process, and the photoreceptor 11 having the surface cleaned by this cleaning device is repeatedly used for the image forming process described above. As for the cleaning device 17, a cleaning blade, brush cleaning, roll cleaning and the like may be used, and among these, it is preferable to use a cleaning blade. Examples of the material of the cleaning blade include urethane rubber, neoprene rubber, silicone rubber, and the like.

The image forming apparatus of the exemplary embodiment may further include an erasing light irradiation device as the charge eraser 18, as shown in FIG. 2. Alternatively, a brush, film or the like having a charge erasing ability may also be used instead. This allows, when the photoreceptor 11 is repeatedly used, prevention of the phenomenon of the residual potential of the photoreceptor 11 being carried over to the subsequent cycles.

Next, another embodiment of the image forming apparatus will be described.

Figure 3:
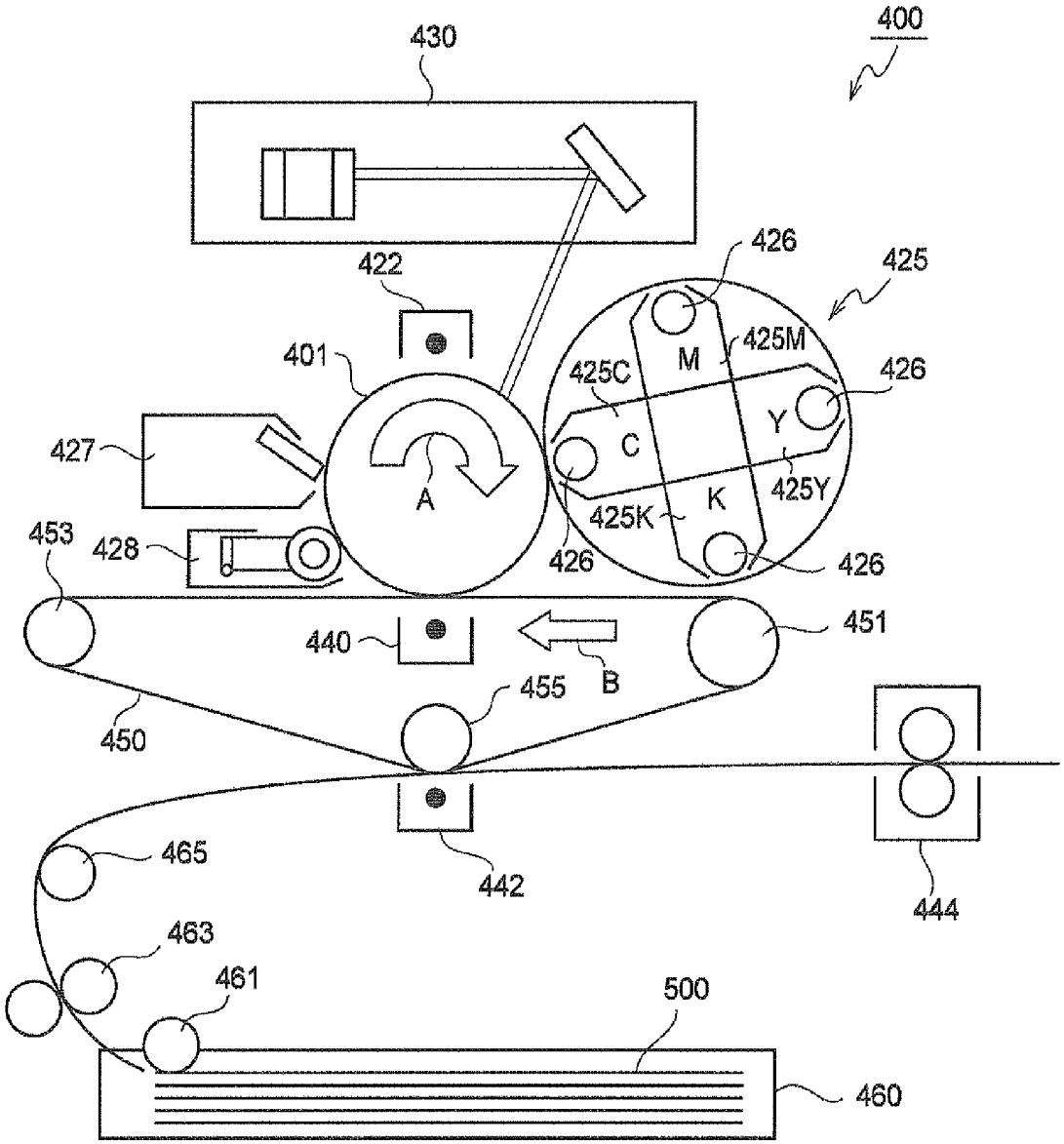
FIG. 3 is a cross-sectional view depicting an outline of the basic configuration of another example of the image forming apparatus according to the exemplary embodiment of the invention.

FIG. 3 is a cross-sectional view depicting an outline of a basic configuration of another example of the image forming apparatus of the exemplary embodiment. The image forming apparatus 400 shown in FIG. 3 is a so-called four-cycle type image forming apparatus, which forms a toner image of multiple colors with a single electrophotographic photoreceptor. The image forming apparatus 400 includes a photoreceptor drum 401 which rotates in the direction of the arrow A in the drawing at a predetermined speed of rotation under the action of a driving unit (not depicted), and a charging device 422 that charges the outer peripheral surface of the photoreceptor drum 401 is provided above the photoreceptor drum 401.

Above the charging device 422, there is disposed an exposure device 430 including a surface emitting laser array as an exposure light source. The exposure device 430 modulates plural laser beams that are ejected from the light source in accordance with the image to be formed, and also deflects the laser beams to the main scanning direction so as to scan over the outer peripheral surface of the photoreceptor drum 401 in parallel with the axial line of the photoreceptor drum 401. Thereby, an electrostatic latent image is formed on the outer peripheral surface of the charged photoreceptor drum 401.

A developing device 425 is disposed laterally to the photoreceptor drum 401. The developing device 425 includes a roller-shaped holder that is disposed to be rotatable. There are four holding units formed in the inside of this holder, and each holding unit is provided with a developing unit 425Y, 425M, 425C or 425K. The developing units 425Y, 425M, 425C and 425K each include a developing roller 426, and respectively store a toner having a color of yellow (Y), magenta (M), cyan (C) and black (K) inside the developing unit.

Formation of full color images in the image forming apparatus 400 is carried out by the formation of an image by the photoreceptor drum 401 four times. In other words, in order for the photoreceptor drum 401 to form an image four times, the charging device 422 repeats charging of the outer peripheral surface of the photoreceptor drum 401 every time the photoreceptor drum 401 forms an image once. The exposure device 430 repeats scanning the laser beam which has been modulated in accordance with any of the image data of Y, M, C and K colors representing the color image to be formed, over the outer peripheral surface of the photoreceptor drum 401, while converting the image data used in the modulation of the laser beam, every time the photoreceptor drum 401 forms an image once. Furthermore, the developing device 425 repeats operating a developing unit that is facing the outer peripheral surface, with the developing roller 426 of any of the developing units 425Y, 425M, 425C and 425K facing the outer peripheral surface of the photoreceptor drum 401, to develop the electrostatic latent image formed on the outer peripheral surface of the photoreceptor drum 401 in determined colors, and to form a toner image of the colors on the outer peripheral surface of the photoreceptor drum 401, every time the photoreceptor drum 401 forms an image of each color, while rotating the holder so as to change the developing unit used in the development of the electrostatic latent image. Thereby, the photoreceptor drum 401 forms an image of each color, and toner images of Y, M, C and K colors are sequentially formed on the outer peripheral surface of the photoreceptor drum 401.

Approximately below the photoreceptor drum 401, an endless intermediate transfer belt 450 is disposed. The intermediate transfer belt 450 is stretched over rollers 451, 453 and 455, and is disposed such that the outer peripheral surface is in contact with the outer peripheral surface of the photoreceptor drum 401. The rollers 451, 453 and 455 rotate as a result of the driving force of the motor, which is not depicted in the drawing, being transferred, and make the intermediate transfer belt 450 to revolve in the direction of the arrow B in FIG. 3.

On the opposite side of the photoreceptor drum 401 with respect to the intermediate transfer belt 450, a transfer device (transfer unit) 440 is disposed, and the toner images of Y, M, C and K colors that have been sequentially formed on the outer peripheral surface of the photoreceptor drum 401, are transferred to the image forming surface of the intermediate transfer belt 450, one color at a time, by the transfer device 440. Eventually, all of the images of Y, M, C and K colors are disposed on the intermediate transfer belt 450.

Furthermore, on the opposite side of the developing device 425 with respect to the photoreceptor drum 401, a lubricant supplying device 428 and a cleaning device 427 are disposed on the outer peripheral surface of the photoreceptor drum 401. When the toner images formed on the outer peripheral surface of the photoreceptor drum 401 are transferred to the intermediate transfer belt 450, a lubricant is supplied to the outer peripheral surface of the photoreceptor drum 401 by the lubricant supplying device 428, and in the outer peripheral surface, the area in which toner images were held and then transferred is cleaned by the cleaning device 427.

A transfer medium holding unit 460 is disposed below the intermediate transfer belt 450, and a large number of sheets of paper 500 as a recording medium are stacked and held inside the transfer medium holding unit 460. On the diagonally upper left side of the transfer medium holding unit 460, a takeout roller 461 is disposed, and on the downstream side in the direction of takeout of the paper 500 by the takeout roller 461, a pair of rollers 463 and a roller 465 are disposed in order. A sheet of paper (recording medium) 500 that is stacked and located on the uppermost side, is taken out from the transfer medium holding unit 460 as the takeout roller 461 rotates, and is conveyed by the pair of rollers 463 and the roller 465.

On the opposite side of the roller 455 with respect to the intermediate transfer belt 450, a transfer device 442 is disposed. The paper 500 conveyed by the pair of rollers 463 and the roller 465 is conveyed to an area interposed between the intermediate transfer belt 450 and the transfer device 442, and the toner image formed on the image forming surface of the intermediate transfer belt 450 is transferred to the paper 500 by the transfer device 442. On the downstream side with respect to the transfer device 442 in the direction of conveyance of the paper 500, a fixing device 444 equipped with a pair of fixing rollers is disposed. The paper 500 having the toner image transferred thereon is discharged out of the image forming apparatus 400 after the transferred toner image is subjected fusion fixing by the fixing device 444, and the paper is placed on the catch tray (not depicted).

Next, an example of the process cartridge of the exemplary embodiment will be described.

Figure 4:
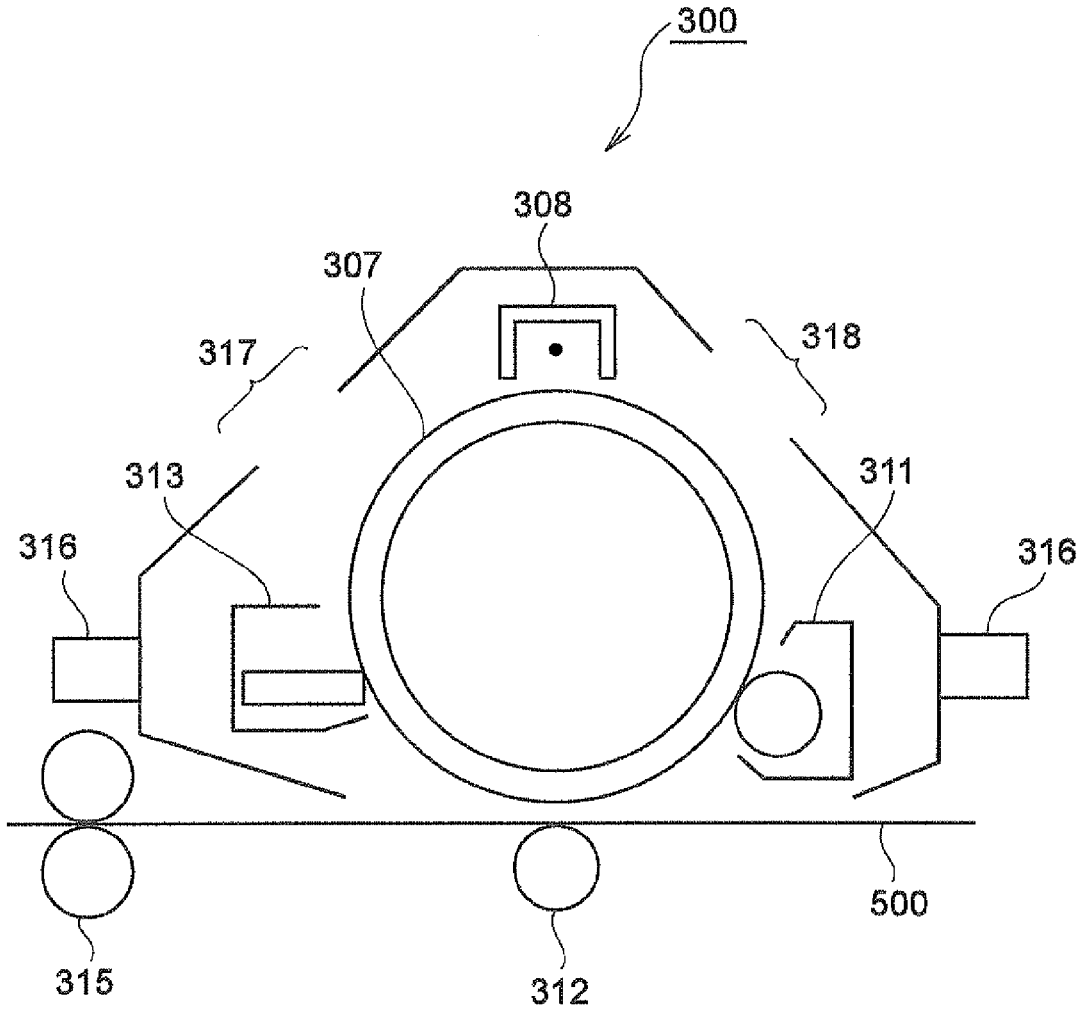
FIG. 4 is a cross-sectional view depicting an outline of the basic configuration of an example of the process cartridge according to the exemplary embodiment of the invention.

FIG. 4 is a cross-sectional view depicting an outline of a basic configuration of an example of the process cartridge of the exemplary embodiment. The process cartridge 300 includes a photoreceptor 307, a charging device 308, a developing device 311, a cleaning device 313, an aperture 318 for exposure, and an aperture 317 for exposure after elimination of charge, which are combined and integrated using a mounting rail 316.

This process cartridge 300 is freely attachable to and detachable from the main body of the image forming apparatus which includes a transfer device 312, a fixing device 315 and other constituent elements that are not depicted, and constitutes the image forming apparatus together with the body of the image forming apparatus and the like.

The recording medium 500 that is used in the exemplary embodiment is not particularly limited as long as it is a medium capable of receiving the toner image formed on the photoreceptor and transferred. For example, in the case of transferring the toner image directly from the photoreceptor to a recording medium such as paper, the paper is the recording medium. Also, in the case of using an intermediate transfer medium, the intermediate transfer medium is the recording medium.

EXAMPLES

Hereinafter, the present invention will be specifically described by way of Examples, but the invention is not intended to be limited by these Examples.

Example 1

Formation of Intermediate Layer 100 parts by weight of zinc oxide (average particle size 70 nm; test product manufactured by Tayca Corporation) is mixed with 500 parts by weight of toluene while being stirred, and 1.5 parts by weight of a silane coupling agent (trade name: KBM603, manufactured by Shin-Etsu Chemical Co., Ltd.) is added. The mixture is stirred for 2 hours. Subsequently, toluene is distilled off by distillation under reduced pressure, and baking is carried out at 150° C. for 2 hours.

38 parts by weight of a solution prepared by dissolving 60 parts by weight of the thus obtained surface-treated zinc oxide, 15 parts by weight of a curing agent (blocked isocyanate; trade name: SUMIDUR 3175, manufactured by Sumitomo-Bayer Urethane Co., Ltd.), and 15 parts by weight of a butyral resin (trade name: S-LEC BM-1, manufactured by Sekisui Chemical Co., Ltd.) in 85 parts by weight of methyl ethyl ketone, and 25 parts by weight of methyl ethyl ketone are mixed. The mixture is dispersed for 2 hours with a sand mill using glass beads of 1 mm ϕ, to obtain an intermediate layer dispersion liquid. 0.005 parts by weight of dioctyltin dilaurate is added as a catalyst to the obtained dispersion liquid, and thus an intermediate layer coating liquid is obtained. This coating liquid is applied on an aluminum substrate having a diameter of 84 mm, a length of 340 mm and a thickness of 1 mm, by a dip coating method, and the substrate is subjected to drying and curing at 160° C. for 100 minutes, to obtain an intermediate layer having a thickness of 20 μm.

Formation of Charge Generating Layer

Subsequently, a mixture composed of 15 parts by weight of hydroxygallium phthalocyanine, which is used as a charge generating material, 10 parts by weight of a vinyl chloride-vinyl acetate copolymer resin (trade name: VMCH, manufactured by Union Carbide Japan KK), and 300 parts by weight of n-butyl alcohol, is dispersed using a sand mill for 4 hours. The resulting dispersion liquid is dip-coated on the intermediate layer and dried at 100° C. for 10 minutes, to form a charge generating layer having a thickness of 0.2 μm.

Formation of Charge Transporting Layer

Subsequently, a coating liquid is prepared by sufficiently mixing and dissolving 45 parts by N,N'-bis(3-methylphenyl)-N,N'-diphenylbenzidine and 55 parts by weight of bisphenol Z-polycarbonate resin (trade name: TS2050, viscosity average molecular weight 50,000, manufactured by Teijin Chemicals, Ltd.) in 300 parts by weight of tetrahydrofuran and 100 parts by weight of monochlorobenzene, and this coating liquid is dip-coated, as a charge transporting layer, on the aluminum substrate having up to the charge generating layer formed thereon. The coating liquid is dried at 125° C. for 60 minutes, to form a charge transporting layer having a thickness of 19 μm.

Formation of Surface Layer

Subsequently, 55 parts by weight of the charge transporting material presented as Compound Example I-21, 43 parts by weight of the charge transporting material presented as Compound Example I-19, and 2 parts by weight of melamine having a structure shown below are dissolved in 200 parts by weight of t-BuOH. The resulting coating liquid is dip-coated, as a surface layer, on the aluminum substrate having up to the charge transporting layer formed thereon, and is dried at 150° C. for 40 minutes, to form a surface layer having a thickness of 6 μm.

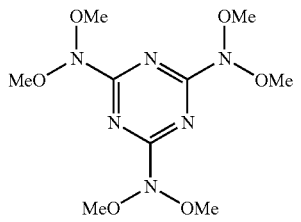

Evaluation

—Image Degradation/Image Degradation after Standing—

The obtained photoreceptor is mounted on a DOCUCENTRE COLOR500 (trade name) manufactured by Fuji Xerox Corp., and 10,000 sheets per day of a full-page halftone image at a density of 40% are printed under high temperature and high humidity conditions at 29° C. and 80% RH. It is verified whether image degradation occurs in every 1000$^{th}$ sheet of the printed images.

Furthermore, the photoreceptor is left to stand under high temperature and high humidity for 14 hours, and the first print after a lapse of 14 hours is carried out by printing a full-page halftone image at a density of 40%. Thus, the image degradation after standing is checked.

The results are shown in Table 3. The evaluation criteria are as follows.

A: No image degradation occurs.

B: Slight image degradation occurs, but the printing ability recovers after printing of about 10 sheets. Practically non-problematic.

C: Image degradation occurs, and impossible to use.

—Residual Potential after Running (High Temperature-High Humidity Environment and Low Temperature-Low Humidity Environment)—

The residual potential is measured by the following method, and evaluation is carried out.

The residual potential is measured after printing the first sheet and the 10,000$^{th}$ sheet of a full-page halftone image at a density of 40%, using a surface potentiometer installed in the DOCUCENTRE COLOR500, separately under high temperature and high humidity conditions at 29° C. and 80% RH and under low temperature and low humidity conditions at 10° C. and 20% RH. The differences are determined, and the absolute values of the differences are taken as the amount of change of the residual potential. The amount of change of the residual potential is evaluated according to the following criteria.

The results are shown in Table 3. The evaluation criteria are as follows.

A: The amount of change of the residual potential is 20 V or smaller.

B: The amount of change of the residual potential is greater than 20 V and smaller than or equal to 60 V.

C: The amount of change of the residual potential is greater than 60 V.

The ionization potential of the various materials is measured using a photoelectron spectroscopy in air, AC-2 (trade name) manufactured by Riken Keiki Co., Ltd., as described above. The ionization potentials are shown in the following Table 1.

Examples 2 to 20 and Comparative Examples 1 to 6

An intermediate layer, a charge generating layer and a charge transporting layer are formed according to the method described in Example 1.

Subsequently, a surface layer is formed by the same method as described in Example 1, except that the charge transporting material indicated in Table 1 or Table 2 is used correspondingly, the content of the material and the layer thickness are correspondingly changed to the respective values indicated in Table 1 or Table 2. When changing the layer thickness, the amount of the solvent t-BuOH is adjusted, and coating is carried out.

The evaluation is carried out in the same manner as in Example 1.

TABLE 1

| | Charge transporting material 1 | | | Charge transporting material 2 | | | Charge transporting material 3 | | | | |
|---|---|---|---|---|---|---|---|---|---|---|---|
| | Type | Content X [parts by weight] | Ionization potential | Type | Content X [parts by weight] | Ionization potential | Type | Content X [parts by weight] | Ionization potential | Melamine | Thickness (μm) |
| Example 1 | 1-21 | 55 | 5.70 | 1-19 | 43 | 5.53 | — | 0 | — | 2 | 6 |
| Example 2 | 1-21 | 60 | 5.70 | 1-19 | 38 | 5.53 | — | 0 | — | 2 | 6 |
| Example 3 | 1-21 | 65 | 5.70 | 1-19 | 33 | 5.53 | — | 0 | — | 2 | 6 |
| Example 4 | 1-21 | 55 | 5.70 | 1-19 | 43 | 5.53 | — | 0 | — | 2 | 10 |
| Example 5 | 1-21 | 55 | 5.70 | 1-19 | 43 | 5.53 | — | 0 | — | 2 | 15 |
| Example 6 | 1-21 | 55 | 5.70 | 1-19 | 43 | 5.53 | — | 0 | — | 2 | 17 |
| Example 7 | 1-21 | 56 | 5.70 | 1-27 | 41 | 5.44 | — | 0 | — | 3 | 6 |
| Example 8 | 1-21 | 55 | 5.70 | 1-27 | 40 | 5.44 | — | 0 | — | 5 | 6 |
| Example 9 | 1-8 | 42 | 5.77 | 1-19 | 38 | 5.53 | 1-26 | 18 | 5.31 | 2 | 7 |
| Example 10 | 1-8 | 45 | 5.77 | 1-19 | 40 | 5.53 | 1-26 | 14 | 5.31 | 1 | 7 |
| Example 11 | 1-8 | 49 | 5.77 | 1-19 | 38 | 5.53 | 1-26 | 12 | 5.31 | 1 | 7 |
| Example 12 | 1-8 | 45 | 5.77 | 1-19 | 43 | 5.53 | 1-26 | 10 | 5.31 | 2 | 7 |
| Example 13 | 1-8 | 47 | 5.77 | 1-16 | 40 | 5.50 | 1-14 | 11 | 5.35 | 2 | 7 |
| Example 14 | 1-8 | 45 | 5.77 | 1-16 | 43 | 5.50 | 1-26 | 8 | 5.31 | 4 | 6 |
| Example 15 | 1-8 | 45 | 5.77 | 1-16 | 40 | 5.50 | 1-26 | 8 | 5.31 | 7 | 6 |
| Example 16 | 1-8 | 47 | 5.77 | 1-16 | 41 | 5.50 | 1-14 | 10 | 5.35 | 2 | 6 |
| Example 17 | 1-8 | 44 | 5.77 | 1-16 | 44 | 5.50 | 1-14 | 10 | 5.35 | 2 | 6 |
| Example 18 | 1-8 | 45 | 5.77 | 1-31 | 40 | 5.50 | 1-30 | 10 | 5.35 | 5 | 6 |

TABLE 1-continued

| | Charge transporting material 1 | | | Charge transporting material 2 | | | Charge transporting material 3 | | | | |
|---|---|---|---|---|---|---|---|---|---|---|---|
| | Type | Content X [parts by weight] | Ionization potential | Type | Content X [parts by weight] | Ionization potential | Type | Content X [parts by weight] | Ionization potential | Melamine | Thickness (μm) |
| Example 19 | 1-8 | 45 | 5.77 | 1-31 | 42 | 5.50 | 1-30 | 10 | 5.35 | 3 | 6 |
| Example 20 | 1-8 | 44 | 5.77 | 1-31 | 44 | 5.50 | 1-30 | 10 | 5.35 | 2 | 6 |

TABLE 2

| | Charge transporting material 1 | | | Charge transporting material 2 | | | Charge transporting material 3 | | | | |
|---|---|---|---|---|---|---|---|---|---|---|---|
| | Type | Content X [parts by weight] | Ionization potential | Type | Content X [parts by weight] | Ionization potential | Type | Content X [parts by weight] | Ionization potential | Melamine | Thickness (μm) |
| Comparative Example 1 | 1-21 | 40 | 5.70 | 1-19 | 58 | 5.53 | — | 0 | — | 2 | 7 |
| Comparative Example 2 | 1-21 | 40 | 5.70 | 1-27 | 57 | 5.44 | — | 0 | — | 3 | 7 |
| Comparative Example 3 | 1-8 | 38 | 5.77 | 1-19 | 48 | 5.53 | 1-26 | 10 | 5.31 | 4 | 7 |
| Comparative Example 4 | 1-8 | 43 | 5.77 | 1-19 | 47 | 5.53 | 1-26 | 8 | 5.31 | 2 | 7 |
| Comparative Example 5 | 1-8 | 40 | 5.77 | 1-19 | 35 | 5.53 | 1-26 | 10 | 5.31 | 15 | 7 |
| Comparative Example 6 | 1-8 | 43 | 5.77 | 1-19 | 38 | 5.53 | 1-26 | 8 | 5.31 | 11 | 10 |

TABLE 3

| | Evaluation | | | |
|---|---|---|---|---|
| | Image degradation | Image degradation after standing | Residual potential after running | |
| | High temperature high humidity | | High temperature high humidity | Low temperature low humidity |
| Example 1 | A | A | A | A |
| Example 2 | A | A | A | A |
| Example 3 | A | A | A | A |
| Example 4 | A | A | A | A |
| Example 5 | A | A | B | A |
| Example 6 | A | A | B | B |
| Example 7 | A | A | A | A |
| Example 8 | A | A | A | A |
| Example 9 | A | B | A | A |
| Example 10 | A | B | A | A |
| Example 11 | A | A | A | A |
| Example 12 | A | A | A | A |
| Example 13 | A | A | A | A |
| Example 14 | A | A | A | A |
| Example 15 | A | A | B | B |
| Example 16 | A | A | A | A |
| Example 17 | A | A | A | A |
| Example 18 | A | A | B | A |
| Example 19 | A | A | A | A |
| Example 20 | A | A | A | A |
| Comparative Example 1 | A | B | B | C |
| Comparative Example 2 | A | B | C | C |
| Comparative Example 3 | A | C | A | A |
| Comparative Example 4 | A | C | B | B |
| Comparative Example 5 | A | B | C | C |
| Comparative Example 6 | A | A | C | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated.

What is claimed is:

1. An electrophotographic photoreceptor comprising:

a conductive substrate;

an intermediate layer;

a photosensitive layer; and a surface layer, in this order, the surface layer including at least one selected from the group consisting of a guanamine compound and a melamine compound, and two or three charge transporting materials each including a reactive substituent selected from the group consisting of —OH, —$OCH_3$, —$NH_2$, —SH, and —COOH, and respectively having mutually different ionization potentials of from 5.31 to 5.77, in an amount of about 90% by weight or more relative to the total solid content of the surface layer, when the number of charge transporting materials contained in the surface layer is 2, the content ratio X of each of the two charge transporting materials satisfying the following Formula (1-2), and when the number of charge transporting materials contained in the surface layer is 3, the content ratio X of each of the three charge transporting materials satisfying the following Formula (1-3):

$$X(1) \geq X(2) \quad \text{Formula (1-2)}$$

$$X(1) \geq X(2) \geq X(3) \quad \text{Formula (1-3)}$$

wherein in Formulae (1-2) and (1-3), X(1) represents a content ratio expressed by % by weight of a charge transporting material that has the highest ionization potential among the two or three charge transporting materials; X(2) represents a content ratio expressed by % by weight of a charge transporting material that has the second highest ionization potential among the two or three charge transporting materials; X(3) represents a content ratio expressed by % by weight of a charge transporting material that has the third highest ionization potential among the three charge transporting materials; in Formula (1-2), X(1) is from 55% by weight to 65% by weight relative to the total solid content of the surface layer; and in Formula (1-3), X(2) is from 38% by weight to 44% by weight relative to the total solid content of the surface layer.

2. The electrophotographic photoreceptor of claim 1, wherein when the number of charge transporting materials contained in the surface layer is 2, X(1)≥2X(2) is satisfied. and when the number of charge transporting materials contained in the surface layer is 3, X(2)≥2X(3) is satisfied.

3. The electrophotographic photoreceptor of claim 1, wherein when the number of charge transporting materials contained in the surface layer is 2, X(1)>X(2) is satisfied, and when the number of charge transporting materials contained in the surface layer is 3, X(1)>X(2)>X(3) is satisfied.

4. The electrophotographic photoreceptor of claim 1, wherein the surface layer comprises three transporting materials each including a reactive substituent selected from the group consisting of —OH, —$OCH_3$, —$NH_2$, —SH, and —COOH, and respectively having mutually different ionization potentials.

5. The electrophotographic photoreceptor of claim 1, wherein the surface layer comprises the two or three charge transporting materials each including a reactive substituent selected from the group consisting of —OH, —$OCH_3$, —$NH_2$, —SH, and —COOH, and respectively having mutually different ionization potentials, in an amount of about 94% by weight or more relative to the total solid content of the surface layer.

6. The electrophotographic photoreceptor of claim 1, wherein the surface layer has a thickness of from about 5 μm to about 15 μm.

7. The electrophotographic photoreceptor of claim 1, wherein the two or three charge transporting materials each including a reactive substituent and respectively having mutually different ionization potentials, are selected from the group consisting of compounds having a structure represented by the following Formula (I):

$$F—((—R^{12}—X)_{n1}(R^{13})_{n3}—Y)_{n2} \qquad \text{Formula (I)}$$

wherein in Formula (I), F is an organic group derived from a compound capable of hole-transporting; $R^{12}$ and $R^{13}$ are each independently an alkylene group having from 1 to 5 carbon atoms which may be branched; n1 is 0 or 1; n2 is an integer of from 1 to 4; n3 is 0 or 1; X is an oxygen atom, NH or a sulfur atom; and Y is —OH, —$OCH_3$, —$NH_2$, —SH or —COOH.

8. The electrophotographic photoreceptor of claim 1, wherein the surface layer includes two charge transporting materials and the content ratio X of each of the two charge transporting materials satisfy the Formula (1-2).

9. The electrophotographic photoreceptor of claim 1, wherein the surface layer includes three charge transporting materials and the content ratio X of each of the three charge transporting materials satisfy the Formula (1-3).

10. An image forming apparatus comprising:

the electrophotographic photoreceptor according to claim 1;

a charging device that charges the electrophotographic photoreceptor;

an exposure device that exposes the surface of the charged electrophotographic photoreceptor to form an electrostatic latent image;

a developing device that develops the electrostatic latent image formed on the surface of the electrophotographic photoreceptor to form a toner image;

a transfer device that transfers the toner image formed on the surface of the electrophotographic photoreceptor onto a surface of a recording medium; and a cleaning device that cleans the surface of the electrophotographic photoreceptor.

11. The image forming apparatus of claim 10, wherein when the number of charge transporting materials contained in the surface layer is 2, X(1)≥2X(2) is satisfied, and when the number of charge transporting materials contained in the surface layer is 3, X(2)≥2X(3) is satisfied.

12. The image forming apparatus of claim 10, wherein when the number of charge transporting materials contained in the surface layer is 2, X(1)>X(2) is satisfied, and when the number of charge transporting materials contained in the surface layer is 3, X(1)>X(2)>X(3) is satisfied.

13. The image forming apparatus of claim 10, wherein the surface layer comprises three or more charge transporting materials each including a reactive substituent selected from the group consisting of —OH, —$OCH_3$, —$NH_2$, —SH, and —COOH, and respectively having mutually different ionization potentials.

14. The image forming apparatus of claim 10, wherein the surface layer comprises the two or three charge transporting materials each including a reactive substituent selected from the group consisting of —OH, —$OCH_3$, —$NH_2$, —SH, and —COOH, and respectively having mutually different ionization potentials, in an amount of about 94% by weight or more relative to the total solid content of the surface layer.

15. The image forming apparatus of claim 10, wherein the two or three charge transporting materials each including a reactive substituent and respectively having mutually different ionization potentials, are selected from the group consisting of compounds having a structure represented by the following Formula (I):

$$F—((—R^{12}—X)_{n1}(R^{13})_{n3}—Y)_{n2} \qquad \text{Formula (I)}$$

wherein in Formula (I), F is an organic group derived from a compound capable of hole-transporting; $R^{12}$ and $R^{13}$ are each independently an alkylene group having from 1 to 5 carbon atoms which may be branched; n1 is 0 or 1; n2 is an integer of from 1 to 4; n3 is 0 or 1; X is an oxygen atom, NH or a sulfur atom; and Y is —OH, —$OCH_3$, —$NH_2$, —SH or —COOH.

16. A process cartridge that is attachable to and detachable from an image forming apparatus and comprises:

the electrophotographic photoreceptor according to claim 1; and at least one selected from the group consisting of a charging device that charges the electrophotographic photoreceptor, an exposure device that exposes the surface of the charged electrophotographic photoreceptor to form an electrostatic latent image, a developing device that develops the electrostatic latent image formed on the surface of the electrophotographic photoreceptor to form a toner image, a transfer device that transfers the toner image formed on the surface of the electrophotographic photoreceptor onto a surface of a recording medium, and a cleaning device that cleans the surface of the electrophotographic photoreceptor.

* * * * *